United States Patent [19]

Brieu

[11] Patent Number: 4,627,176

[45] Date of Patent: Dec. 9, 1986

[54] DRYING CYLINDER FOR A WEB MATERIAL MACHINE, PARTICULARLY A PAPER MACHINE

[75] Inventor: Francois Brieu, Saint-Cloud, France

[73] Assignee: Chleq Frote et Cie, Paris, France

[21] Appl. No.: 752,197

[22] PCT Filed: Oct. 24, 1984

[86] PCT No.: PCT/FR84/00242

§ 371 Date: Jun. 24, 1985

§ 102(e) Date: Jun. 24, 1985

[87] PCT Pub. No.: WO85/01969

PCT Pub. Date: May 9, 1985

[30] Foreign Application Priority Data

Oct. 27, 1983 [FR] France ..... 83 17132

[51] Int. Cl.[4] ..... F26B 13/18

[52] U.S. Cl. ..... 34/115; 34/119; 34/124; 165/90; 219/244; 219/470

[58] Field of Search ..... 219/244, 469, 470, 471; 165/90; 34/115, 119, 124

[56] References Cited

U.S. PATENT DOCUMENTS 3,203,678 8/1965 Sawyer et al. ..... 34/54
3,624,353 11/1971 Bjorklund ..... 219/470
3,805,020 4/1974 Bates ..... 219/469
4,440,214 4/1984 Wedel ..... 165/90
4,535,230 8/1985 Brieu ..... 219/469

FOREIGN PATENT DOCUMENTS 1318133 1/1963 France .

*Primary Examiner*—Larry I. Schwartz
*Attorney, Agent, or Firm*—A. W. Breiner

[57] ABSTRACT

The outer side surface of the drying cylinder (1) is delimited by a plurality of coaxial rims (2) having the same radius, arranged side by side and separated two by two by an axial space (7), and made of a good heat-conducting material. Each rim (2) is heated and cooled independently from the others by a heating member (8) and a cooling member (11) housed into a subrim (3) surrounding by the rim (2). The heating is provided for example by an electric resistance and the cooling by circulation of cold water, the control being provided by means of remote controlled relays (10). Each rim (2) is rotationally integral with a hub (5) wedged to a drive shaft (6). A comb (26) having teeth (27) engaged into the spaces (7) avoids the winding of material around the cylinder (1) which is in depression conditions in order to favor the heat exchanges by suction of the material against the cylinder (1). Applications to the equipment of dry ends and post dry ends of paper-, cardboard- or other web material machines.

18 Claims, 3 Drawing Figures

DRYING CYLINDER FOR A WEB MATERIAL MACHINE, PARTICULARLY A PAPER MACHINE

TECHNICAL FIELD

This invention concerns papermaking machines, and refers in particular to a drying cylinder designed for equipping a drier and/or after-drier section for machines producing paper, cardboard or any other material in webs.

PRIOR ART

In papermaking machines, the paper web is already well formed when leaving the press section, the main problem then is to bring the percentage of water in the web, which ranges from 60 to 65% approximately, down to a value lying between 5 and 10%. This is performed in a drier section in which the wet paper web coming out of the last press and containing 60 to 65% of water, is put in close contact with a number of large drying cylinders whose diameter is generally 1.5 m, and which are internally stem heated, the wet paper web being strongly pressed against the outer surface of the cylinders by means of felt. The drying cylinders or drums are set up in two rows, a top and a bottom row, and are generally grouped in trains of three to twenty cylinders, each train being associated with its own felt which unrolls towards the bottom or the top, while each felt is dried by a felt drying cylinder or drum. The paper web successively moves from a lower drying cylinder to an upper drying cylinder, and vice versa. Suitably placed blowers remove the thin steam saturated air film which tends to continuously form and stagnate on the wet paper web, and the steam released is gathered by a hood and exhausted. In these driers with internally steam heated drying cylinders, 1.3 to 1.5 kg of steam are required, depending on the installations and the type of pulp, to evaporate one litre of water contained in the wet paper web.

In drier sections developed more recently, the felt has been suppressed and each drying cylinder has been surrounded by an individual hood with numerous openings, in the form of holes and slots, communicating with a hot air blowing installation and a steam exhausting installation.

These two types of driers have a common disadvantage, their operating cycle presents an important inertia and the control for the operation of the heavy and complex mechanical and thermal assemblies which constitute these driers, poses numerous problems. For this reason, a large number of devices have been designed and are used for controlling the quantity and the quality of the steam taken in by the drying cylinders at the different stages of the paper web evaporation in the drier. In practice, the major difficulty to be overcome consists in maintaining an even degree of dryness over the whole width of the web or also in keeping the required moisture configuration. For this reason, the modern papermaking machines comprise various devices which permit, by means of an additional hot air flow, local dehydration of the web parts which are too wet, or by spraying water, wetting of the web parts which have become too dry.

The various disadvantages mentioned above are also common in the papermaking machines in which the drier cylinders have been partly or completely replaced by a enormous single cylinder known as the machine glared cylinder whose diameter can range from 3 to 6 m, and which is surrounded by a high-efficiency hood.

In some papermaking machines, the drier is followed by a size press. In this case, the latter is itself followed by an after-drier section, which is in fact a second drier section smaller in number of cylinders than the main drier, and it is obvious that these papermaking machines also have, as far as the drier unit is concerned, the same diadvantages as the state of the art installations mentioned above.

After going over one or two cooling cylinders, which are fitted at the drier or after-drier end, the paper web can be considered as being fully formed and can then be wound on the main rolls. But, in most cases, the paper webs, before being wound on the main rolls, are treated in order to improve their surface condition and/or their internal structure. When these treatments are carried out on the papermaking machine itself, the paper web coming from the drier or after-drier goes through calender stack to improve the surface condition, while the internal structure can be improved by moistening the paper web coming from the drier with humidifiers or moistening machines. A humidifier is a device which sprays water in the form of drops as tiny as possible, over the paper web coming from the drier, in order to provide a moisture level lying between 5 and 10%. A calender stack is a vertical mechanical device comprising several carefully polished metal rollers, horizontally resting on one another and tightened together with an adjustable force, by means of a frame. The paper web coming from the cooling cylinders goes through the calender stack rollers, which are cooled or heated by air externally blown through jets, in order to contract or expand the metal locally and correct where necessary the defects in thickness of the paper web. As well as making the web thickness regular, the calender stack decreases by compression the natural roughness of paper.

But the surface condition improving treatment can also be performed outside the papermaking machine in a super calender comprising several rollers alternately made out of polished metal and compressed and formed paper. Super calenders, which are very heavy machines consuming a lot of energy, and which generate a lot of waste, improve the superficial evenness of the paper web by the compression and surface friction forced upon the web.

DISCLOSURE OF THE INVENTION

The purpose of the invention is to present a drying cylinder which would overome the disadvantages of the state of the art drying cylinders as regards control, in such a way that a certain number of the cylinders according to the invention could replace and/or be added to some of the current cylinders, downline of a certain number of these cylinders, in order to improve the moisture profile in the drier or after-drier.

The main purpose of the invention is to present a drying cylinder which provides a better control of the humidity level and thickness of the web, and which performs at least partly, the functions generally carried out by the humidifiers and/or calender stack,or the super calenders, so that these devices could be, if not suppreseed at least simplified in design, or so that the general result could be improved and achieved much faster.

To this effect, the drying cylinder according to the invention, designed for equipping a drier and/or after-drier section in a machine producing material in webs, namely paper, and of the type with a hollow structure internally heated and presenting an outer cylindrical lateral surface, circular in section, against which a web is to be applied, wherein the outer lateral surface is delimited by several cylindrical rims, circular in section, with the same radius, coaxially placed side by side, and made out of good heat conducting material, each rim having a heat exchange with an individually controlled internal heating device that the rim surrounds, and each rim being integral in rotation with at least one hub fixed to at least one cylinder rotating shaft. By individually controlling the heat in the various rims, the moisture profile can be selectively adjusted. This advantage is increased if, according to an additional feature specific to the invention, each rim also exchanges heat with an individually controlled internal cooling device that the rim surrounds, as then each rim can be successively heated and cooled, depending on the requirements along the longitudinal section of the width applied against the corresponding rim, in response to the correction signals coming from appropriate sensors, such as the ones currently used in papermaking machines.

Preferably, each rim is directly in contact and integral in rotation with an underlying component that the rim surrounds, and which contains at least one heating component of the corresonding heating device and/or one cooling components of the corresponding cooling device, so that the rim can be heated and cooled by conduction which is an effective and efficient heating system, and flexible as regards control.

In order to reinforce the independence of the various rims, each rim is separated from the next rim(s) by a small axial clearance.

Preferably, the two axial ends of the cylinder are sealed in order to prevent energy losses through ventilation during rotation.

In this case, it is advantageous that the inside of the cylinder be connected to a vacuum pressure source so that the sheet of material is sucked against the rims through the free axial gaps between the latter, which helps heat exchanges between the cylinder and the web.

When the rims are separated by an axial gap, it is also advantageous, in addition, to replace the scrapers generally used to prevent the web from wrapping around the cylinder, by at least one comb separating the material sheet from the cylinder, and whose teeth are introduced into the axial gaps between the rims.

Advantageously, the heating device is an electrical device, whose heating component comprises an electrical resistance power supplied from the outside of the cylinder, which can be carried out in a relatively simple, self-contained and quite cheap way, with a good energetic efficiency.

But it is also possible that the heating device be a system in which a heat-conveying fluid circulates, and whose heating component comprises a tubular element through which a hot heat-conveying fluid circulates. Other heating means can also be considered, such as induction heating for instance.

As to the cooling device for each rim, it is advantageously carried out in the form of a cooling fluid circulating system in a tubular cooling element, a cheap and practial cooling fluid to this effect being cold water for instance. Circulation of a fluid in the tubular element of a cooling and/or heating device can be controlled by an electric valve, while the power supply to the resistance for an electrical heating device and/or to the valve of a cooling device and/or of a heating device can be controlled by a relay located in the cylinder.

In these different cases, each relay is for instance switched by an independent remote control. In a preferred embodiment, the remote control comprises a receiver specific to the corresponding relay, and sensitive to one particular control frequency of a transmitter common to all the relays and with several transmission frequenices, their number corresponding to the number of relays, the transmitter itself being controlled for each frequency by a specific switch. In the last embodiment, it is advantageous that the relay switching frequencies pass through at least one of the power supply lines to the resistance and/or to the corresponding valve.

However, the remote control is not limited in its design to the frequncy control of the various relays, and it is also possible that each relay be for instance switched by an individual photo-sensitive cell which is attached to it and which picks up a specific light beam. In the case where the rims are separated by axial gaps, it is also possible that each relay be a proximity microswitch relay actuated by a comb tooth introduced into the axial gap between two rims, which makes the best use of the presence of a separating comb between the material web and the cylinder.

BRIEF DESCRIPTION OF THE DRAWINGS

This invention will be better understood with a particular exemple of embodiment, described hereafter in a non-restrictive way, with reference to the attached drawing in which.

BEST WAY FOR CARRYING OUT THE INVENTION

Figure 1:
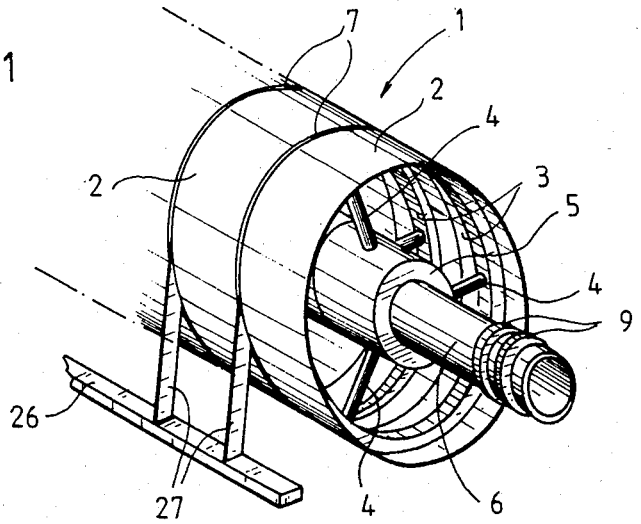
FIG. 1 is a partial perspective view of a drying cylinder complying with the invention
Figure 2:
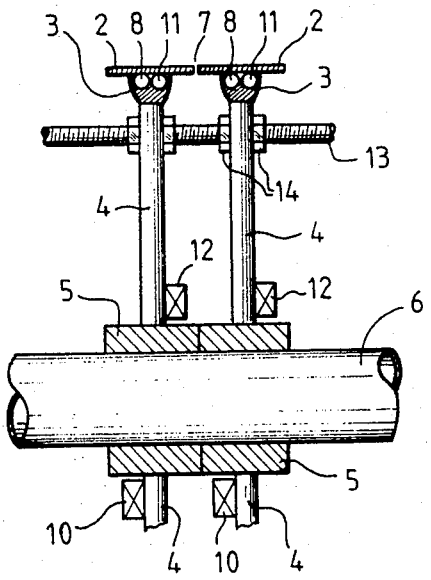
FIG. 2 is a partial schematic axial cross-sectional view of the drying cylinder in FIG. 1.

With reference to FIGS. 1 and 2, the drying cylinder 1 comprises several cylindrical rims 2, circular in section and with the same radius, in copper or stainless steel, each of which is integral with an underlying component 3, and referred to as the sub-rim in the rest of this specification. Each sub-rim has the shape of a circular ring with a cross-section almost like an isosceles trapezium with inclined and slightly curved sides, surrounded by the corresponding rim 2 which the sub-rim supports. Through its larger base, turned towards the outside, each sub-rim 3, also in copper or stainless steel, is integral with the inner side of the corresponding rim 2, while through its smaller base, turned towards the inside, sub-rim 3 is connected by three rigid spokes 4 to the outer side surface of a hub 5 presenting an axial hole through which hub 5 is made integral in rotation with a drive shaft 6 by keys or splines for instance.

The axial dimension of each hub 5 slightly exceeds that of the corresponding rim 2, so that the assembly of rims 2, sub-rims 3, spokes 4 and hubs 5 abutting one against the other can be fitted and fixed to shaft 6, while leaving a free gap 7 of 1 mm approximately between two neighbouring rims. The cylindrical outer side surface, circular in section of drying cylinder 1 is thus delimited by the polished outer side surfaces of five to ten independent rims 2, permeter of width, rims 2 being fitted coaxially side by side, and separated two by two by axial gap 7, drying cylinder 1 having the same outside dimensions as the state of the art steam heated cylinders, that is an outside diameter of 1.5 m approximately and a length lying between 1.5 and 10 m.

A heating device and a cooling device are associated with each individual rim 2. Each heating device comprises an electrical heating component in the form of an electrical resistance 8 located in a toric duct embedded in the corresponding sub-rim 3. This electrical resistance 8 which, by Joule effect, provides for the heating of sub-rim 3, and thus by conduction heating of rim 2, is power supplied by a line (not represented in FIGS. 1 and 2) radially running along a spoke 4 or inside, then going through the corresponding hub 5 and shaft 6, and then running through shaft 6 which is hollow, up to two rotating collector rings 9 supported by shaft 6 on either one of its axial ends. Against rings 9 are applied fixed brushes connected to the electric current distribution network.

The supply to the heating resistance 8 is controled by a control component in the form of a relay 10 which is mounted on the corresponding power supply line, remote controlled from the outside of cylinder 1 and fitted to a spoke 4 next to the corresponding hub 5.

Each cooling device in which circulates a cooling fluid also comprises a cooling component and a control component.The cooling component is a toric duct 11 which is also embedded in the corresponding sub-rim 3, and through which water is flowing. The water which runs cold into duct 11 is conduction heated by sub-rim 3 and rim 2 which thus are both cooled. Duct 11 is connected to a cold water supply line and to a hot water draining line (not represented in FIGS. 1 and 2) which run radially either through a spoke 4 or along a spoke 4, then go through the corresponding hub 5 and shaft 6 in which they respectively run into a main cold water supply pipe and a main hot water draining pipe, which are for instance coaxial and run up to an axial end of hollow shaft 6, where both pipes are each connected by rotating ends to one of the two external lines of cylinder 1, designed for cold water supply and drainage of the heated up water.

The water circulation in each duct 11 is regulated by a control component in the form of a solenoid valve 12 fitted onto a spoke 4 near the corresponding hub 5, which is driven electrically by an integrated and remote controlled relay in the same way as relay 10.

Each rim 2 can thus be successively heated and cooled, regardless of the others, by the individual control of the associated heating and cooling devices, depending on the requirements and according to control signals which are computer generated for instance, according to the detection signals from the humidity or thickness sensors suitably arranged opposite the paper web, as is the case in the state of the art papermaking machines. These control signals are transmitted to each relay controlling the power supply to the corresponding heating resistance 8 or the corresponding solenoid valve 12 by an independent remote control.

In order to avoid any risk of buckling of the various sub-assemblies each of which comprises a rim 2, sub-rim 3, spokes 4 and the corresponding hub 5, spokes 4 of the various sub-assemblies can be connected by threaded tie-rods 13 which go through spokes 4 in a direction paralled to the axis of rotation of shaft 6 and are rigidly attached to each spoke 4 by two nuts 14 screwed onto the corresponding tie-rod 13 and tightened on either side of spoke 4 against the outer side surface of the latter. The various spokes 4 connected by a tie-rod 13 are kept apart from one another at constant distances.

Figure 3:
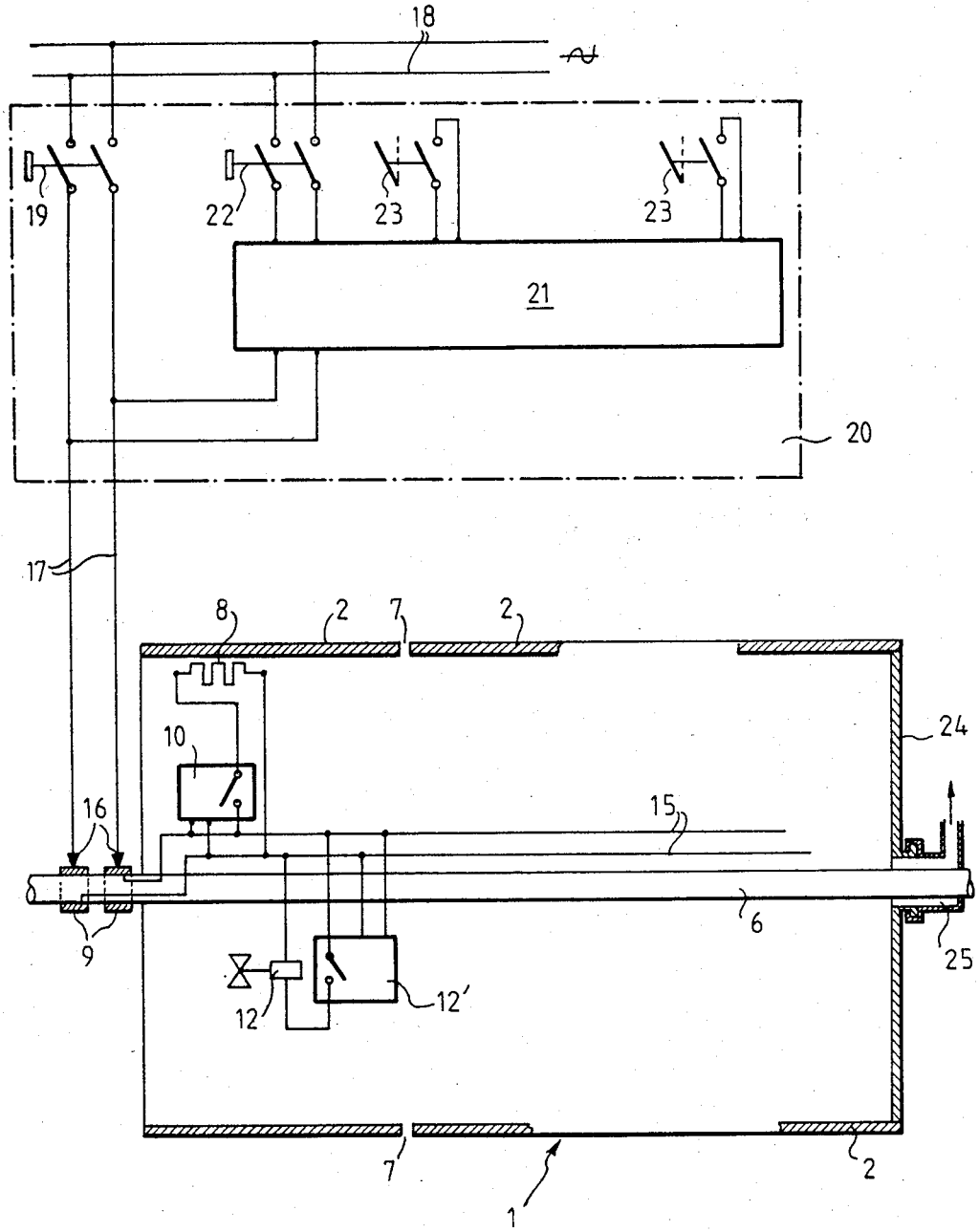
FIG. 3 is a diagram illustrating the principle of the electronic control of the drying cylinder as shown in FIGS. 1 and 2.

FIG. 3 schematically represents an embodiment of an electronic remote control for heating and cooling a drying cylinder such as 1. To each rim 2, correspond two frequency controlled static relays which are each switched by an AC control signal with a specific frequency. For each rim 2, relay 10 associated with its specific receiver, sensitive to a first specific frequency, controls the supply to heating resistance 8 connected in parallel on an internal and bipolar power supply line 15 for all the heating resistances 8 and all the solenoid valves 12. This relay 10 is also connected in parallel on the internal power supply line 15. Each solenoid valve 12, also connected in parallel on internal line 15, is driven by its integrated static relay 12', itself associated with its specific receiver, sensitive to a second specific frequency, and connected in parallel on internal line 15. The two wires of the line are each connected to one of the two rotating collector-rings 9 of shaft 6, against which a fixed brush 16 for an externl and bipolar power supply line 17 is applied, in parallel on a mains power supply line 18, 220 V AC for instance, by means of a protective switch 19 located in a box or on a control panel 20. The latter mainly contains a single AC signal transmitter 21 which is connected in parallel on the mains line 18 by means of a second protective switch 22. This transmitter 21 can transmit signals at specific frequencies whose number corresponds to the sum of the number of heating resistances 8 and number of solenoid valves 12, and this transmitter 21 is controlled by switches 23 in equal number to the number of specific transmission frequencies. The transmitter 21 is also connected to the external power supply line 17, downline from the protective switch 19, so that each signal transmitted at a specific frequency is supplied via power supply lines 17 and 15 to relay 10 or relay 12' which are sensitive to this specific frequency.

Thus switching the heating on or off for each rim 2 by supplying or cutting off the supply to the corresponding heating resistance 8, as well as switching the cooling on or off for this rim 2 by opening or closing the corresponding solenoid valve 12, are controlled by the transmission or transmission interrupt by transmitter 21 of a signal with a specific frequency received by a relay 10 or a relay 12' which is switched by this signal. Preferably, switches 23 which each control the transmission of a signal at a specific frequency are automatically actuated in any known and adequate way, in order to obtain an automatic regulation of the heating and/or cooling of rims 2, independently from each other.

The internal equipment of such a cylinder 1 with the different relays 10 and 12' and the various corresponding electrical connections, as well as the different solenoid valves 12 and the various corresponding water lines, does not pose any major problem, given the large internal volume available and the repetitive aspect of the assemblies all the components of which are easily accessible for maintenance work when the cylinder is stopped.

In order to avoid energy loses through ventilation, cylinder 1 is sealed and relatively air-tight at both its axial ends, as shown schematically at the right-hand side axial end of cylinder 1 in FIG. 3. This can be carried out by means of two radial discs such as 24, one of which delimits around the part of shaft 6 which goes through it, a suction opening connected by an external bell 25 to a vacuum pressure source, so that the slight vacuum pressure inside rotating cylinder 1 causes a suction around axial gaps 7 between rims 2. Thus the web, as for paper for instance, is sucked and well applied against the outer side surface of rims 2, which improves heat exchanges between the rims 2 and the paper, whose moisture profile can thus be corrected. Indeed, a supply of moisture to too dry an area of the paper can be obtained due to the condensation resulting from the cooling of the rim(s) 2 against which this area of paper is applied, while evaporation at heated rims 2 permits dehydration of the too moist corresponding areas of the paper.

Furthermore, such a drying cylinder 1 helps correcting the thickness profile of the paper, when it is placed upline of a calender stack for instance to which the paper web, locally heated or cooled according to contiguous longitudinal and transversal areas, will provide more or less heat.

In order to prevent the paper web from wrapping around cylinder 1, a comb 26 is used whose teeth 27 in the form of a knife blade are each introduced and slid into an axial gap 7 between two neighbouring rims 2, as schematically shown in FIG. 1.

The invention is not limited to the preferred embodiment which has been described with reference to the FIGS. 1 to 3, but can be subjected to variants. For instance, the heating device can also be a hot heat-conveying fluid system whose flow through a duct such as the one circulating a cooling fluid, is controlled by another solenoid valve electrically driven by a relay.

The various relays of the heating and cooling devices can be controlled by a remote control different from the one described above. For information, each relay can be controlled by a specific photo-sensitive cell which picks up a sepcific light beam or else each relay can be a proximity microswitch relay actuated by tooth 27 of comb 26 when introduced into the axial gap 7 adjacent to the corresponding rim 2. The relays can also be switched by radio-electric waves without passing through the supply line. The web can be applied against the rims by felt through the atmospheric pressure if the cylinder is under vacuum pressure or by the winding tension of the web around the cylinder.

What is claimed is:

1. Drying cylinder designed for equipping a drier and/or after-drier for a machine producing material in webs, namely paper, the cylinder having two axial ends and a hollow structure internally heated and presenting a cylindrical outer side surface, circular in section, against which a web is to be applied, wherein the outer side surface is delimited by several cylindrical rims, circular in section, of the same radius and coaxially placed side by side, and made out of a good heat conducting material, each rim exchanging heat with an individually controlled internal heating device that the rim surrounds, and each rim being integral in rotation with at least one hub fixed to at least one rotating shaft of the cylinder, wherein each rim is separated from a neighboring rim by a small axial gap, and wherein the two axial ends of the cylinder are sealed and relatively gas-tight and wherein the inside of the cylinder is connected to a vacuum pressure source, so that the web is sucked against the rims through the axial gaps between the rims.

2. Drying cylinder for a machine producing material in webs, and in particular for the cross-direction moisture profile control of a papermaking machine, said cylinder comprising a tubular structure presenting a substantially cylindrical outer surface of circular cross-section having a central axis around which said tubular structure is rotatably mounted and which is subdivided in a plurality of axially contiguous peripheral cylindrical zones against which a web is to be applied, said cylinder further comprising a heating installation including, for each of said cylindrical zones, an individually controlld heating device provided with at least one heating member in radial correspondence with the respective cylindrical zone, with several heating members of said heating installation being axially spaced apart from one another, wherein each of said cylindrical zones is defined by an outer face of one of a plurality of cylindrical rims of a good heat-conducting material and of the same radius, which are coaxially placed side by side and axially spaced apart from one another so that two adjacent rims are separated by a small axial gap, each rim being integral in rotation, by means of at least three substantially radially extending spokes with at least one hub member fixed to at least one shaft rotating about said cylinder aixs, each heating member for each heating device being embedded under said outer face of the respective rim so that each said heating member is in conduction heat-exchange relationship with said respective rim, and each said heating device being further provided with one electrically operated control member for simultaneously actuating all said heating members of said respective heating device and which is fixed to at least one of said respective hub members and spokes connecting said respective rim to at least one respective hub member.

3. Drying cylinder as in claim 2, wherein each of said rims is directly in contact and integral in rotation with a respective underlying component which the rim surrounds and which contains all said heating members of said respective heating device.

4. Drying cylinder as in claim 2, wherein the cylinder further comprises a cooling installation including, for each said rim, an individually controlled cooling device provided with at least one cooling member, with several cooling members of said cooling installation being axially spaced apart from one another, each cooling member of each cooling device being embedded under said outer face of the respective rim so that each said cooling member is in conduction heat-exchange relationship with said respective rim, and each said cooling device is further provided with one electrically operated control member for simultaneously actuating all said cooling members of said respective cooling device and which is fixed to at least one of said respective hub members and spokes connecting said respective rim to at least one respective hub member.

5. Drying cylinder as in claim 4, wherein each of said rims is directly 8 in contact and integral in rotation with a respective underlying component which the rim surrounds and which contains all said cooling members of said respective cooling device.

6. Drying cylinder as in claim 2, wherein a tooth of a comb for separating the web from said cylinder is introduced in each axial gap between two adjacent rims.

7. Drying cylinder as in claim 2, wherein each heating member of each heating device is an electrical resistance power supplied from the outside of said cylinder.

8. Drying cylinder as in claim 2, wherein each heating member of each heating device comprises a tubular duct in which a hot heat-conveying fluid is circulated.

9. Drying cylinder as in claim 4, wherein each cooling member of each cooling device comprises a tubular duct in which a cooling fluid is circulated.

10. Drying cylinder as in claim 8, wherein said electrically operated control member of each said heating device comprises an electric valve which controls the circulation of said heat-conveying fluid in each said duct of said respective heating device.

11. Drying cylinder as in claim 6, wherein said electrically operated control member of each said cooling device comprises an electric valve which controls the circulation of said cooling fluid in each said duct of said respective cooling device.

12. Drying cylinder as in claim 11, wherein said electric valve is power supplied by means of a relay which is fixed to at least one of said respective hub members and spokes.

13. Drying cylinder as in claim 7, wherein said electrically operated control member of each said heating device comprises a relay which power supplies each said electrical resistance of said heating device and which is fixed to at least one of said respective hub members and spokes.

14. Drying cylinder as in claim 13, wherein said relay of each said electrically operated control member is capable of being independently switched on and off by an independent remote control system.

15. Drying cylinder as in claim 14, wherein said independent remote control system comprises a specific receiver sensitive to a specific frequency and associated to said relay of each said electrically operated control member, said remote control system transmitting control signals to said relay by means of a transmitter transmitting signals at a plurality of frequencies and controlled by an equal plurality of switches so that the actuation of a specific switch controls the transmission of control signals at a corresponding specific frequency to which a corresponding specific receiver is sensitive.

16. Drying cylinder as in claim 15, wherein said control signals at a plurality of frequencies pass through at least one power supply line to each said electrically operated control member.

17. Drying cylinder as in claim 13, wherein said relay of each said electrically operated control member is switched on and off by a photosensitive cell picking up a specific light beam.

18. Drying cylinder as in claim 13, wherein said relay of each said electrically operated control member is a proximity microswitch relay which is actuated by a tooth of a comb introduced in said axial gap between to rims.

* * * * *